United States Patent [19]

Collishaw et al.

[11] Patent Number: 4,503,801

[45] Date of Patent: Mar. 12, 1985

[54] APPARATUS FOR IMPREGNATING OR DISPERSING A PRODUCT IN A THIN SUBSTRATE

[75] Inventors: Peter S. Collishaw; Michael Wilkinson, both of Nottingham, England

[73] Assignees: Caligen Foam Limited, Lancashire; W. E. Saxby (Nottingham) Limited, Nottingham, both of England

[21] Appl. No.: 321,828

[22] Filed: Nov. 16, 1981

[30] Foreign Application Priority Data

Mar. 15, 1980 [GB] United Kingdom ..... 8008838
Mar. 4, 1981 [GB] United Kingdom ..... 8106769

[51] Int. Cl.[3] ..... B05C 1/00; B05D 1/28; B05D 3/02; B05D 5/00

[52] U.S. Cl. ..... 118/246; 118/249; 118/262; 427/244; 427/366; 427/374.1; 427/428

[58] Field of Search ..... 427/244, 296, 365, 366, 427/428, 374.1; 428/311; 118/246, 249, 262

[56] References Cited

U.S. PATENT DOCUMENTS

| | | | |
|---|---|---|---|
| 2,227,494 | 1/1941 | Gold | 118/246 X |
| 3,647,525 | 3/1972 | Dahlgren | 118/262 X |
| 4,041,197 | 8/1977 | Gagne | 427/428 X |
| 4,070,520 | 1/1978 | Volz et al. | 427/244 X |
| 4,159,356 | 6/1979 | Jablonski | 427/244 |
| 4,180,317 | 12/1979 | Schroter | 118/246 X |
| 4,339,481 | 7/1982 | Beekhuis | 427/428 |

*Primary Examiner*—Michael R. Lusignan
*Attorney, Agent, or Firm*—Alan H. Levine

[57] ABSTRACT

A method of dispersing a substance in a thin flexible substrate of open-celled foam structure comprising continuously moving a sheet of the substrate, applying the substance to the substrate in a melted condition at an elevated temperature, compressing the substrate, subsequently allowing the substrate to expand to its normal size and thereby draw the melted substance into the open-celled structure to impregnate the substrate and cooling the substrate to solidify the impregnated substance. The method is preferably carried out using apparatus incorporating means for controlling the quantity of substance applied to the substrate by an applicator roller and arranged to permit the substrate to expand while still in contact with the applicator roller.

15 Claims, 1 Drawing Figure

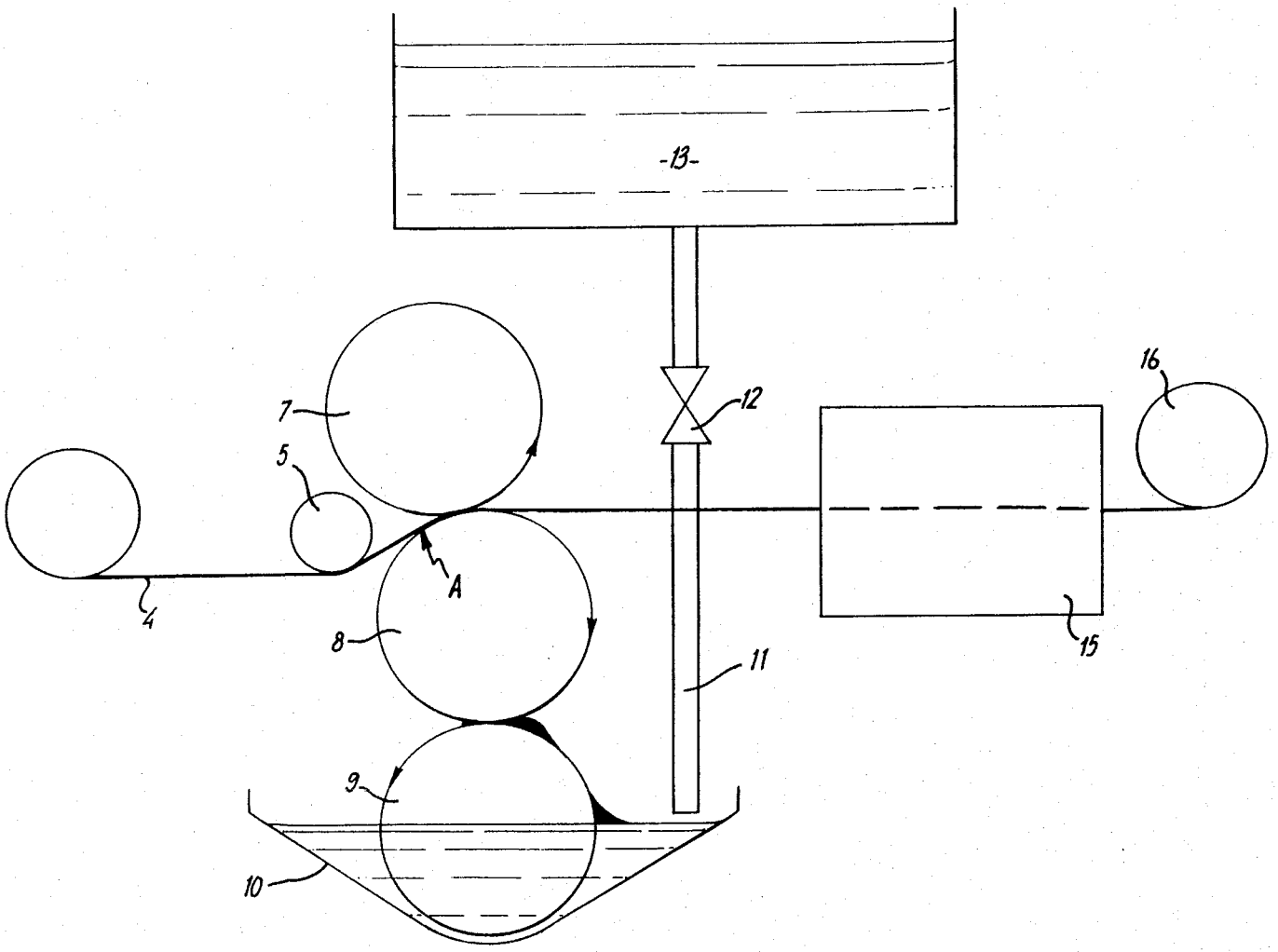
16
15
13
12
11
A
7
5
8
9
10
4

APPARATUS FOR IMPREGNATING OR DISPERSING A PRODUCT IN A THIN SUBSTRATE

This invention relates to a method and apparatus for impregnating or dispersing a substrate with a product. The invention is particularly applicable to the dispersion of product through thin substrates of open-celled foam structure.

It is necessary for various purposes to introduce products into foamed plastics materials or other materials of open-celled foam structure. It is possible to introduce substances by coating the foam structure with the substance but this does not result in uniform dispersion throughout the structure of the foam but rather concentrates the substance in layers at or adjacent the opposite surfaces. It is also possible to impregnate or disperse a substance through a material of open-celled foam structure by immersing the material in the substance to be dispersed. However in relation to thin substrates this introduces problems in providing adequate support for the treated substrate to avoid tearing or disintegration and requires the subsequent application of heat to dry the impregnated substance.

It is an object of the present invention to provide a method and apparatus for dispersing product through articles of thin open-celled foam structure in which these disadvantages are obviated or mitigated.

The invention provides apparatus for dispersing a substance in a thin flexible substrate of open-celled foam structure comprising means for continuously moving a sheet of the substrate, a pair of nip rollers between which the sheet is passed, means for applying the substance to one of said rollers which serves as an applicator roller for transferring the substance to said substrate, and means permitting expansion of said substrate while still in contact with said applicator roller.

Preferably said expansion is permitted due to the axis of rotation of said applicator roller being displaced from the axis of rotation of the other of said nip rollers in the direction of travel of the substrate.

The invention also provides apparatus for dispersing a substance in a thin flexible substrate of open-celled foam structure comprising means for continuously moving a sheet of the substrate, a pair of nip rollers between which the sheet is passed, one of which rollers serves as an applicator roller for transferring the substance to said substrate, a trough or tank for said substance, and a pick-up roller extending into said trough or tank to pick up substance therefrom and transfer same to said applicator roller, said pick-up roller being driven by a variable speed drive independent of the drive to said nip rollers.

The invention also provides apparatus for dispersing a substance in a thin flexible substrate of open-celled foam structure comprising means for continuously moving a sheet of the substrate, a pair of nip rollers between which the sheet is passed, one of which rollers serves as an applicator roller for transferring the substance to said substrate, and means for varying the length of the arc of contact between said substrate and said applicator roller.

An embodiment of the invention will now be described, by way of example only, with reference to the accompanying diagrammatic FIGURE which shows one form of apparatus according to the invention.

Referring to the FIGURE, the apparatus is used to disperse a fabric softening agent in a substrate comprising a thin sheet 4 of polyurethane foam having a thickness of less than three millimeters and preferably of the order of one to two millimeters. The apparatus consists of a nip roller 8 mounted in fixed centres and a pick-up or feed roller 9 mounted directly below and on the same vertical centreline as the nip roller 8. Feed roller 9 runs in tank 10 which contains the heated softening agent. The roller 9 is vertically adjustable to micrometer settings thus allowing roller 8 to be coated with a precise depth of the softening agent. A roller 5 is mounted ahead of and above the roller 8 and has a vertical adjustment which enables the arc of contact of the sheet 4 with the roller 8 to be varied before the sheet enters the impregnation nip provided between the roller 8 and a roller 7 which is vertically adjustable to micrometer setting and offset from the vertical centre line of the rollers 8 and 9. The offset nip allows for recovery of the sheet 4 whilst still in surface contact with the roller 8, thus ensuring complete absorbtion of the softening agent.

The sheet 4 is drawn from a supply roll and fed under the roller 5 which is vertically adjusted to select the desired length of contact between the sheet and the surface of the roller 8 prior to entry into the nip constituted by rollers 8 and 7. The nip rollers 7 and 8 are both driven. The pick-up roller 9 runs on a separate variable speed drive and is partially immersed in the fabric softening agent in the tank 10. The roller 9 is vertically adjusted to a suitable setting allowing a precise thickness of the softening agent to be carried to the contact point A where it is held by the sheet 4 before entering the nip. On leaving the nip the sheet re-expands while still in surface contact with the roller 8 thus fully absorbing the coating of fabric softener.

The product is stored in a heated storage tank 13 and metered through a valve 12 and feed pipe 11 to a tank 10 where the level is automatically controlled. Following application of the softener to the substrate, the substrate is rapidly cooled by passing through a refrigeration unit 15 and is wound on to a take-up roll 16.

In the case of a fabric softener such as stearic acid ethoxylate the reservoir 13 is heated to a temperature of between 37° and 53° C. to melt the softener which is then delivered through the pipe 11 to the trough 10. The trough is heated to a similar temperature to maintain the softener in a molten condition and the pick-up roller 9 serves during its rotation to carry a quantity of the fabric sotener to the roller 8 from whence it is applied to the foam 4 in the nip between the rollers 8 and 7. The transfer roller 8 and pick-up roller 9 are both heated by suitable means to maintain the softener in a liquid state.

After leaving the nip between the rollers 7 and 8 the treated foam sheet is allowed to expand freely, thereby creating suction within the cellular structure which serves to draw the fabric softener into and disperse it through the foam. Effective and relatively uniform dispersion is achieved due to the thin nature of the sheet. After the fabric softener is dispersed it is passed through the cooling zone 15 where its temperature is reduced to below the melting point of the stearic acid ethoxylate, thereby resulting in solidification of the fabric softener within the structure of the foam. Sections of the thus treated foam may then be added to driers along with clothing or other fabrics with which they are tumbled during the drying cycle, the temperature within the drier causing melting of the fabric softener which is then gradually released from the foam substrate and applied to the articles being dried.

The arrangement described enables a substance to be dispersed in a uniform manner through the structure of a thin sheet of a cellular carrier in a simple and effective manner by a single pass continuous process and results in more uniform dispersion of impregnant than can be obtained with conventional coating techniques. Moreover, when the substance is applied in a hot melt form it will subsequently solidify an attaining ambient temperature and it is not therefore necessary to utilise additional heating to drive off water as in the case where substances are applied in aqueous solution or dispersion. Cooling can of course be assisted by refrigeration if required but this will not be necessary in all circumstances.

Various modifications may be made without departing from the invention. For example the speed of travel of the substrate may be varied to suit requirements and the degree of compression may be altered provided it is sufficient to ensure complete dispersion of the added substance through the cross-section of the foam after expansion. Compression of the foam could also be effected by means other than rollers. The rate of uptake of substance may also be varied in any convenient manner; for example by increasing the gap setting between the nip rollers 8 and 7 and increasing the running speed of the roller 9 a greater quantity of substance will be presented to the substrate for dispersing into the open cell structure. Alternatively the rate of uptake may be altered by use of engraved rollers. The temperature and viscosity of the substance may also be varied dependent on its nature.

We claim:

1. Apparatus for dispersing a substance in a thin flexible substrate of open-celled foam structure comprising means for continuously moving a sheet of the substrate, a pair of nip rollers between which the sheet is passed, one of which rollers serves as an applicator roller for transferring the substance to said substrate, and means for varying the length of the arc of contact between said substrate and said applicator roller.

2. Apparatus according to claim 1 wherein said means for varying said arc of contact comprises an auxiliary roller rotatably mounted ahead of said applicator roller in the direction of travel of the substrate and bodily movable in a direction normal to the surface of the substrate.

3. Apparatus according to claim 1 or 2 including support means for a roll of substrate to be treated and take-up means for the impregnated substrate.

4. Apparatus for dispersing a substance in a thin flexible substrate of open-celled foam structure, the apparatus comprising means for continuously moving a sheet of the substrate in an untensioned condition, a pair of rollers defining a nip between which the sheet is compressed, means for applying the substance to one of said rollers which serves as an applicator roller for transferring the substance to said substrate when the latter is in its compressed condition and means permitting expansion of said substrate after passage through said nip while still in contact with said applicator roller whereby to draw said substance into said open-celled foam structure.

5. Apparatus according to claim 4 wherein said expansion is permitted due to the axis of rotation of said applicator roller being displaced from the axis of rotation of the other of said nip rollers in the direction of travel of the substrate.

6. Apparatus according to claim 4 or 5 incorporating means for heating said applicator roller.

7. Apparatus according to claim 4 including means for varying the thickness of substance applied to the substrate by said applicator roller.

8. Apparatus according to claim 7 wherein the other of said nip rollers is movable relative to said applicator roller in a direction to vary the nip therebetween.

9. Apparatus according to claim 4, 5 or 7 wherein both said nip rollers are driven in unison in opposite directions.

10. Apparatus according to claim 5 including a pick-up roller extending into a trough or tank for said substance in order to pick up substance from the trough or tank and transfer some to said applicator roller.

11. Apparatus according to claim 10 wherein said pick-up roller is driven by a variable speed drive independent of the drive to said nip rollers.

12. Apparatus according to claim 10 incorporating means for heating said trough or tank.

13. Apparatus according to claim 12 including a storage tank for said substance connected to said trough and incorporating means for maintaining a constant level of substance in said trough.

14. Apparatus according to claim 13 incorporating means for heating said storage tank.

15. Apparatus according to claim 12 or 14 including means for cooling the substrate after impregnation.

* * * * *